US007082780B2

(12) United States Patent
Stanko et al.

(10) Patent No.: US 7,082,780 B2
(45) Date of Patent: Aug. 1, 2006

(54) COMPACT CHASSIS ROOM AIR CONDITIONER

(75) Inventors: John Stanko, Bayonne, NJ (US); George P. Gabriel, Iselin, NJ (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 10/992,027

(22) Filed: Nov. 18, 2004

(65) Prior Publication Data

US 2005/0115262 A1 Jun. 2, 2005

Related U.S. Application Data

(60) Provisional application No. 60/524,147, filed on Nov. 21, 2003.

(51) Int. Cl.
*F25D 23/12* (2006.01)
*F25D 19/00* (2006.01)
*F25D 17/06* (2006.01)

(52) U.S. Cl. ..... 62/262; 62/298; 62/426; 62/429

(58) Field of Classification Search ..... 62/262, 62/298, 426, 429
See application file for complete search history.

(56) References Cited

U.S. PATENT DOCUMENTS 3,805,542 A 4/1974 Hosoda et al.
3,826,105 A 7/1974 Marsteller
3,839,880 A 10/1974 Premaza
3,898,865 A * 8/1975 Stewart et al. ..... 62/280
3,906,741 A 9/1975 Terry
3,921,416 A 11/1975 Murnane et al.
4,205,597 A * 6/1980 Nawa et al. ..... 62/262
4,667,483 A 5/1987 Hashimoto
5,065,596 A 11/1991 Harris et al.
5,065,597 A 11/1991 Farfaglia et al.
5,085,057 A * 2/1992 Thompson et al. ..... 62/262
5,193,355 A 3/1993 Matsumi
5,222,374 A * 6/1993 Thompson et al. ..... 62/262
5,253,485 A 10/1993 Kennedy et al.
5,335,721 A * 8/1994 Wollaber et al. ..... 165/122
5,542,263 A 8/1996 Choi et al.
5,775,125 A 7/1998 Sakai et al.
5,911,751 A 6/1999 Kim
5,950,446 A 9/1999 Tromblee et al.
6,009,716 A 1/2000 Aoto et al.

(Continued)

*Primary Examiner*—Marc Norman
*Assistant Examiner*—B. Clayton McCraw
(74) *Attorney, Agent, or Firm*—Pearne & Gordon LLP

(57) ABSTRACT

A room air conditioner has a front side portion and a rear side portion for location at an area to receive unwanted heat. The room air conditioner includes an evaporator coil at the front side portion of the air conditioner, and having a left-right centerline extending parallel to a front to rear direction. A condenser coil is at the rear side portion of the air conditioner, and has a left-right centerline extending parallel to the front to rear direction. An air-moving device is located between the evaporator coil and the condenser coil, and has a left-right centerline extending parallel to the front to rear direction. A chassis supports the evaporator coil, the condenser coil, and the air-moving device, and has a left-right centerline extending parallel to the front to rear direction. The centerlines of the evaporator coil, the condenser coil and the air-moving device are all co-linear, and the centerline of the chassis is laterally offset from the centerlines of the evaporator coil, the condenser coil and the air-moving device.

3 Claims, 2 Drawing Sheets

U.S. PATENT DOCUMENTS 6,092,377 A 7/2000 Tso
6,363,735 B1 4/2002 Bushnell et al.
6,460,362 B1 10/2002 Oliveira de Barros et al.
6,460,363 B1 10/2002 Moretti et al.
6,511,282 B1 1/2003 Notohardjono et al.

* cited by examiner

COMPACT CHASSIS ROOM AIR CONDITIONER

RELATED APPLICATION

Benefit of priority is claimed from Provisional Patent Application Ser. No. 60/524,147, filed Nov. 21, 2003.

FIELD OF THE INVENTION

The present invention relates to improvements in the design, construction and manufacture of room air conditioners. The present invention particularly relates to a room air conditioner that has a compact chassis.

BACKGROUND OF THE INVENTION

Room air conditioners are known. A typical room air conditioner is positioned within a window opening or in a through-wall sleeve. Also, the typical air conditioner has a front side portion for location at an area, e.g., a room interior, to be cooled and a rear side portion for location at an area, e.g., an outside environment, to receive unwanted heat. More specifically, at the front side, the air conditioner has an air inlet and an air outlet. Usually, warm air is drawn in through the inlet, across an evaporator coil to cool the air, and then is directed by a blower or fan to the outlet. Similarly, at the rear side, the air conditioner has an air inlet and an outlet. Usually, air is drawn in through the inlet, across condenser coil to deliver unwanted heat to the air, and then the heated air is directed by a blower or fan to the outlet. Commonly, the fans/blowers are parts of an air-moving device, which has a single motor. A chassis of the air conditioner supports the evaporator coil, the condenser coil, and the air-moving device.

Compactness of size has been addressed numerous times with regard to room air conditioner. However, previous room air conditioner designs may still be deficient with regard to achieving a superior balance between size and performance.

SUMMARY OF THE INVENTION

In accordance with one aspect, the present invention provides a room air conditioner having a front side portion for location at an area to be cooled and a rear side portion for location at an area to receive unwanted heat. The room air conditioner includes an evaporator coil at the front side portion of the air conditioner, and that has a left-right centerline extending parallel to a front to rear direction. The air conditioner includes a condenser coil at the rear side portion of the air conditioner, and that has a left-right centerline extending parallel to the front to rear direction. The air conditioner includes an air-moving device located between the evaporator coil and the condenser coil, and that has a left-right centerline extending parallel to the front to rear direction. The air conditioner includes a chassis supporting the evaporator coil, the condenser coil, and the air-moving device. The chassis has a left-right centerline extending parallel to the front to rear direction. The centerlines of the evaporator coil, the condenser coil and the air-moving device are all co-linear, and the centerline of the chassis is laterally offset from the centerlines of the evaporator coil, the condenser coil, and the air-moving device.

DESCRIPTION OF EXAMPLE OF EMBODIMENT

Figure 1:
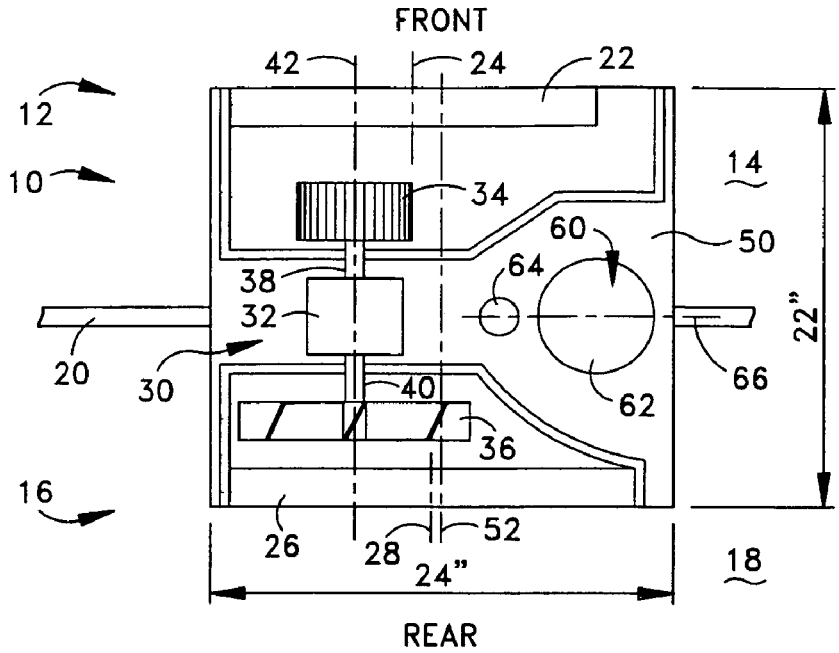
Fig.1 Prior Art
FIG. 1 is a schematic plan view of a typical, known room air conditioner showing the layout of major component.

An example of a typical known room air conditioner 10 is shown in FIG. 1 to provide a reference to which the present invention is to be compared. The air conditioner 10 has a front side portion 12 for location at an area (e.g., a room interior) 14 to be cooled and a rear side portion 16 for location at an area (e.g., an outside environment) 18 to receive unwanted heat. The area 14 to be cooled is separated by a wall 20 from the area 18 that receives the unwanted heat. Although the two areas can be varied, for ease of reference, the area 14 to be cooled is referred as the room 14 and the area 18 that receives the unwanted heat is referred to as the outside 18. Also, it is to be appreciated that the wall 20 may have a variety of configurations, and the wall has a window opening, sleeved aperture, or the like through which the air conditioner 10 extends.

In general, the air conditioner 10 contains components and operates in a manner that is well known in the art. As such, detailed descriptions of the components and the operation are omitted with the understanding that such detailed descriptions are inherently part of this disclosure as will be understood by the person of ordinary skill in the art.

Turning to a few key components that are useful to identify so that the present invention may be appreciated, the air conditioner 10 includes an evaporator coil 22 at the front side portion 12 of the air conditioner. A left-right centerline 24 of the evaporator coil 22 extends parallel to a front to rear direction. By the phrase "left-right centerline," it is to be understood that generally one half of the evaporator 22 is located to each of the left and right sides of the centerline 24. It is to be appreciated that the division into halves need not be exactly precise. Such inability to precisely divide into halves may be due to construction, configuration, or the like. For example, one of the halves may have some additional minor structure or the like, which would cause the inequality in the division. As such, one example of selection of division into halves is via reasonable visual perception of where a division is proper. Such considerations about divisions are equally applicable to all other centerline divisions identified herein.

The air conditioner 10 has a condenser coil 26 at the rear side portion 16 of the air conditioner. A left-right centerline 28 of the condenser coil 26 extends parallel to the front to rear direction. The centerline 28 of the condenser coil 26 may or may not be co-linear with the centerline 24 of the evaporator coil 22. Specifically, the centerlines 24 and 28 may be co-linear (i.e., laid upon each when considered with respect to the left to right direction), or the centerlines may be offset in a left-right sense to each other.

An air-moving device 30 of the air conditioner 10 is located between the evaporator coil 22 and the condenser coil 26. The air-moving device 30 includes a motor 32, a blower wheel 34 operatively connected to the motor and located adjacent to the evaporator coil 22, and a fan blade 36 operatively connected to the motor and located adjacent to condenser coil 26. As will be appreciated by the person of skill in the art, the operative connections shown within FIG. 1 include rotational shafts 38 and 40, respectively. Operation of the motor 32 rotates the shafts 38 and 40, which in turn rotate the blower wheel 34 and fan blade 36, respectively. As will be appreciated, air is moved across each of the evaporator coil 22 and the condenser coil 26.

The air-moving device 30 has a left-right centerline 42 extending parallel to the front to rear direction. Within the shown example, the centerline 42 is the rotational axis of the blower wheel 34 and fan blade 36. The centerlines 24, 28 of the evaporator coil 22 and the condenser coil 26 are not co-linear with the centerline 42 of the air-moving device 30. In the shown example of FIG. 1, the centerline 42 of the air-moving device 30 is clearly offset to the left from the centerlines 24, 28 of the evaporator coil 22 and the condenser coil 26.

A chassis 50 of the air conditioner 10 supports the evaporator coil 22, the condenser coil 26, and the air-moving device 30. The chassis 50 has a left-right centerline 52 extending parallel to the front to rear direction. The centerline 52 of the chassis 50 is laterally offset from the centerlines 24, 28, 42, respectively, of the evaporator coil 22, the condenser coil 26, and the air-moving device 30. In the shown example of FIG. 1, the centerline 52 of the chassis 50 is clearly offset to the right of the centerlines 24, 28, and 42 of the evaporator coil 22, the condenser coil 26, and the air-moving device 30. Within the shown example of FIG. 1, the chassis has dimensions of 22 inches along the front to back direction and 24 inches along the left to right direction.

Also the air conditioner 10 includes a compressor arrangement 60 located at a lateral side of the air-moving device 30. The compressor arrangement 60 includes a compressor 62 and an accumulator 64. The accumulator 64 is located to one side of the compressor 62. The combination of the compressor 62 and the accumulator 64 thus has an elongation in one direction because of the accumulator. Another way of considering this is that the outer periphery footprint of the compressor arrangement 60 (i.e., the compressor 62 and accumulator 64) is elongate in one direction. This elongation is thus the maximum elongation of the compressor arrangement 60. Within the known air conditioners, the maximum elongation is along a line 66 that extends transverse to the front to rear direction. In the shown example, the line 66 is perpendicular to the front to back direction.

Figure 2:
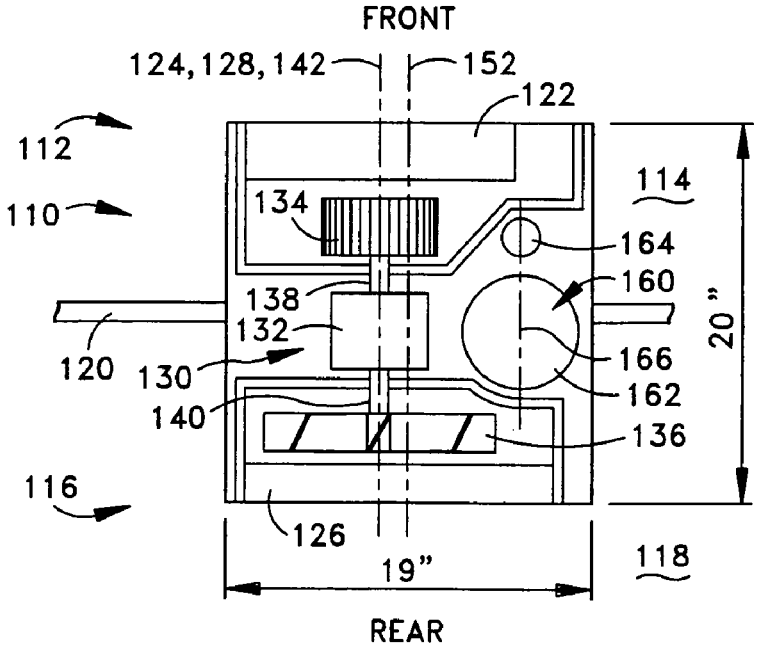
FIG. 2 is a schematic plan view of a room air conditioner in accordance with the present invention.
Figure 3:
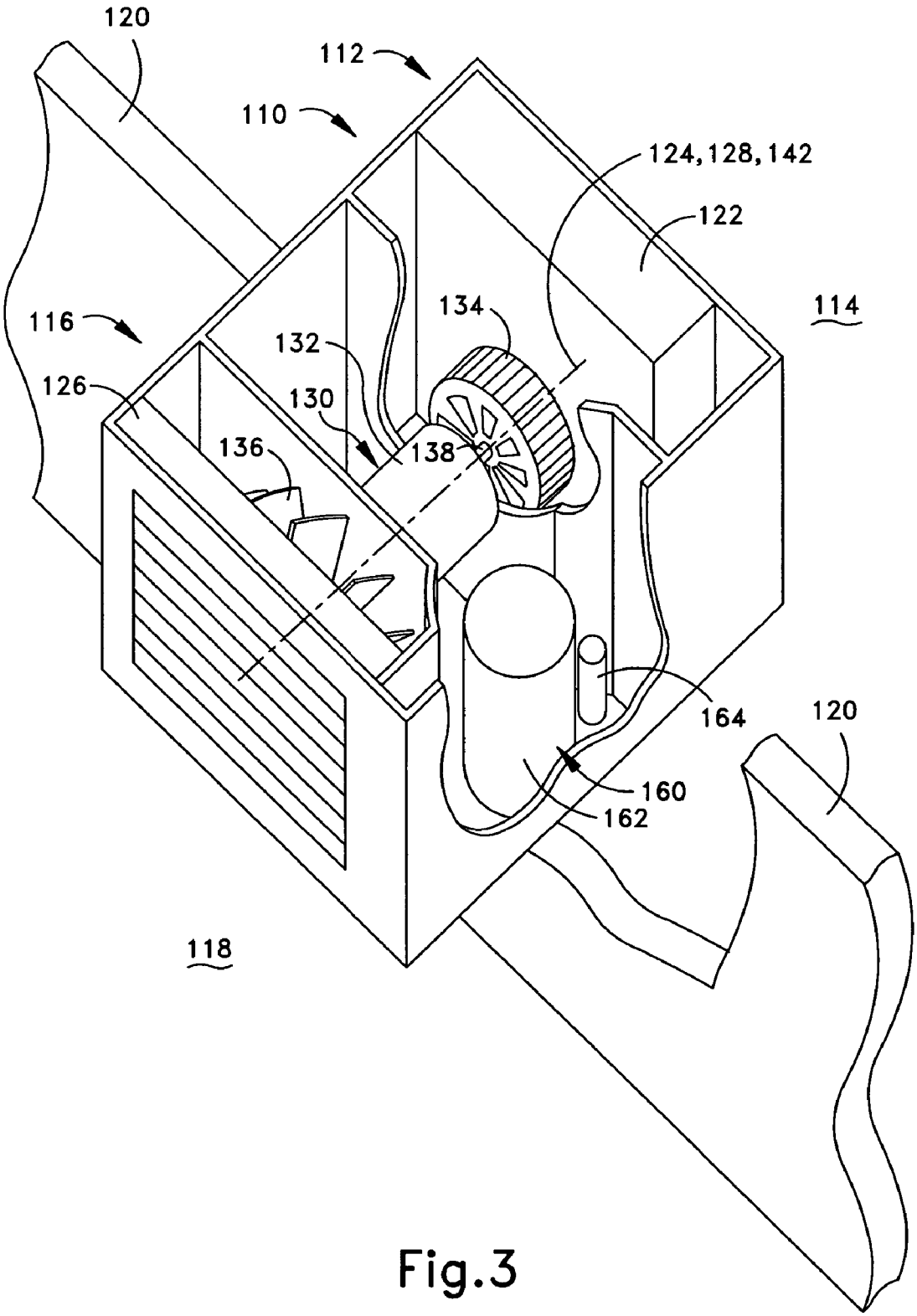
FIG. 3 is a schematic perspective view, partial torn off, of the room air conditioner of FIG. 2.

Turning to an example of the present invention, FIGS. 2 and 3 schematically shows a room air conditioner 110. Similar to the know room air conditioner 10, the air conditioner 110 in accordance with the present invention has a front side portion 112 for location at an area (e.g., a room interior) 114 to be cooled and a rear side portion 116 for location at an area (e.g., an outside environment) 118 to receive unwanted heat. The area 114 to be cooled is separated by a wall 120 from the area 118 that receives the unwanted heat. Although the two areas can be varied, for ease of reference, the area 114 to be cooled is referred as the room 114 and the area 118 that receives the unwanted heat is referred to as the outside. Also, it is to be appreciated that the wall 120 may have a variety of configurations, and the wall has a window opening, sleeved aperture, or the like through which the air conditioner 110 extends. In general, the air conditioner 110 contains components and operates in a manner that is well known in the art. As such, detailed descriptions of the components and the operation are omitted with the understanding that such detailed descriptions are inherently part of this disclosure as will be understood by the person of ordinary skill in the art.

The air conditioner 110 includes an evaporator coil 122 at the front side portion 112 of the air conditioner. A left-right centerline 124 of the evaporator coil 122 extends parallel to a front to rear direction. By the phrase "left-right centerline," it is to be understood that generally one half of the evaporator coil 122 is located to each of the left and right sides of the centerline 124. It is to be appreciated that the division into halves need not be exactly precise. Such inability to precisely divide into halves may be due to construction, configuration, or the like. For example, one of the halves may have some additional minor structure or the like, which would cause the inequality in the division. As such, one example of selection of division is via reasonable visual perception of where a division is proper. Such considerations about divisions are equally applicable to all other centerline divisions identified herein.

The air conditioner 110 has a condenser coil 126 at the rear side portion 116 of the air conditioner. A left-right centerline 128 of the condenser coil 126 extends parallel to the front to rear direction. The centerline 128 of the condenser coil 126 is co-linear (i.e., overlaid upon each other when considered with respect to the left to right direction) with the centerline 124 of the evaporator coil 122.

An air-moving device 130 of the air conditioner 110 is located between the evaporator coil 122 and the condenser coil 126. The air-moving device 130 includes a motor 132, a blower wheel 134 operatively connected to the motor and located adjacent to the evaporator coil 122, and a fan blade 136 operatively connected to the motor and located adjacent to condenser coil 126. As will be appreciated by the person of skill in the art, the operative connections shown within FIG. 2 include rotational shafts 138 and 140, respectively. Operation of the motor 132 rotates the shafts 138 and 140, which in turn rotate the blower wheel 134 and fan blade 136, respectively. As will be appreciated, air is moved across each of the evaporator coil 122 and the condenser coil 126.

The air-moving device 130 has a left-right centerline 142 extending parallel to the front to rear direction. Within the shown example, the centerline 142 is on the rotational axis of the blower wheel 134 and fan blade 136. The centerlines 124, 128 of the evaporator coil 122 and the condenser coil 126 are co-linear with the centerline 142 of the air-moving device 130.

A chassis 150 of the air conditioner 110 supports the evaporator coil 122, the condenser coil 126, and the air-moving device 130. The chassis 150 has a left-right centerline 152 extending parallel to the front to rear direction. The centerline 152 of the chassis 150 is laterally offset from the centerlines 124, 128, 142, respectively, of the evaporator coil 122, the condenser coil 126, and the air-moving device 130. In the shown example of FIG. 2, the centerline 152 of the chassis 150 is clearly offset to the right of the centerlines 124, 128, and 142 of the evaporator coil 122, the condenser coil 126, and the air-moving device 130. Within the shown example of FIG. 2, the chassis 150 has dimensions of 20 inches along the front to back direction and 19 inches along the left to right direction.

Also the air conditioner 110 includes a compressor arrangement 160 located at a lateral side of the air-moving device 130. The compressor arrangement 160 includes a compressor 162 and an accumulator 164. The accumulator 164 is located to one side of the compressor 162. The combination of the compressor 162 and the accumulator 164 thus has an elongation in one direction because of the accumulator. Another way of considering this is that the outer periphery footprint of the compressor arrangement 160 (i.e., the compressor 162 and accumulator 164) is elongate in one direction. This elongation is thus the maximum elongation of the compressor arrangement 160. Within the shown example, the maximum elongation is along a line 166 that extends generally parallel to the front to rear direction.

One of the benefits of centering the air-moving device in line with the evaporator and condenser coils is that there is a better air velocity distribution with respect to both coils, which allowed for the same unit performance in a much smaller package (e.g., 19"W×20"D vs. 24"W×22"D).

It should be evident that this disclosure is by way of example and that various changes may be made by adding, modifying, or eliminating details without departing from the scope of teachings contained in this disclosure. In particular, the discussion and drawings are presented herein by way of example only and other variations are contemplated and considered within the scope of the invention.

What is claimed:

1. A room air conditioner having a front side portion for location at an area to be cooled and a rear side portion for location at an area to receive unwanted heat, the room air conditioner including:

an evaporator coil at the front side portion of the air conditioner, and having a left-right centerline extending parallel to a front to rear direction;

a condenser coil at the rear side portion of the air conditioner, and having a left-right centerline extending parallel to the front to rear direction;

an air-moving device located between the evaporator coil and the condenser coil, and having a left-right centerline extending parallel to the front to rear direction; and a chassis supporting the evaporator coil, the condenser coil, and the air-moving device, and having a left-right centerline extending parallel to the front to rear direction;

the centerlines of the evaporator coil, the condenser coil and the air-moving device all being co-linear, and the centerline of the chassis being laterally offset from the centerlines of the evaporator coil, the condenser coil and the air-moving device;

a compressor arrangement located at a lateral side of the air-moving device, the compressor arrangement having an outer periphery footprint that has a maximum elongation parallel to the front to rear direction;

said compressor arrangement includes a compressor and an accumulator, the accumulator is located along the front to rear direction from the compressor to provide the maximum elongation of the compressor arrangement.

2. A room air conditioner as set forth in claim 1, wherein the compressor arrangement is at least partially nested between the condenser coil and the evaporator coil.

3. A room air conditioner as set forth in claim 1, wherein at least part of the compressor arrangement is located at a distance from the centerlines of the evaporator coil and the condenser coil that is less than the distance from the centerlines of the evaporator coil and the condenser coil to the furthest lateral extent of the evaporator coil and the condenser coil.

* * * * *